US011193288B1

(12) United States Patent
Istel

(10) Patent No.: US 11,193,288 B1
(45) Date of Patent: Dec. 7, 2021

(54) OCTAGONAL EDUCATIONAL STRUCTURE WITH EDUCATIONAL, PROFESSIONAL, PHYSICAL AND MORAL DEVELOPMENTAL ASPECTS

(71) Applicant: Center of the World, Inc., Felicity, CA (US)

(72) Inventor: Jacques-Andre Istel, Felicity, CA (US)

( * ) Notice: Subject to any disclaimer, the term of this patent is extended or adjusted under 35 U.S.C. 154(b) by 0 days.

(21) Appl. No.: 17/221,380

(22) Filed: Apr. 2, 2021

(51) Int. Cl.

| | |
|---|---|
| ***E04H 3/06*** | (2006.01) |
| ***E04H 3/08*** | (2006.01) |
| ***E04H 3/10*** | (2006.01) |
| *E04H 3/22* | (2006.01) |

(52) U.S. Cl.
CPC ..... *E04H 3/06* (2013.01); *E04H 3/08* (2013.01); *E04H 3/10* (2013.01); *E04H 3/22* (2013.01)

(58) Field of Classification Search
CPC .... E04H 3/00; E04H 3/02; E04H 3/06; E04H 3/08; E04H 3/10; E04H 3/22; E04H 9/06; E04H 9/08; E04H 13/00; E04H 13/006; E04B 2001/0053
See application file for complete search history.

(56) References Cited

U.S. PATENT DOCUMENTS 2,154,897 A * 4/1939 Grant ..... E04B 1/34815 52/79.4
2,156,859 A * 5/1939 Lowe ..... E04H 3/08 52/106
D273,228 S * 3/1984 Cotton ..... D25/1
5,855,098 A * 1/1999 Bromer ..... E04H 3/06 52/175
2009/0107063 A1* 4/2009 Pierson ..... E04H 6/005 52/236.1

FOREIGN PATENT DOCUMENTS

| | | | | |
|---|---|---|---|---|
| BR | 202012012531 U2 * | 7/2015 | | |
| CN | 111298451 A * | 6/2020 | | |
| CN | 111997413 A * | 11/2020 | | |
| EP | 0143494 A2 * | 6/1985 | ..... | E04B 1/34336 |
| KR | 2015051752 A * | 5/2015 | | |
| KR | 1529437 B1 * | 6/2015 | | |
| WO | WO-9203628 A * | 3/1992 | | |
| WO | WO-0112922 A1 * | 2/2001 | ..... | B60P 3/0257 |

* cited by examiner

*Primary Examiner* — Ryan D Kwiecinski
(74) *Attorney, Agent, or Firm* — Eric Hanscom

(57) ABSTRACT

An upper "hub and spoke" octagon is connected to a lower "hub and spoke" octagon by vertical shafts. Each of the vertices of both the above-ground and below-ground octagons houses a six-part educational/professional center. At the center of each octagon has a central hub that houses items such as restaurants, first aid centers, rock-climbing walls, etc. Each corridor houses at least two educational subjects, such that visitors are entertained and educated as they walk from one unit to another. The vertical shafts can provide experiences such as skydiving simulators, or just stairs that will allow visitors to get some quality exercise as they tour the invention.

6 Claims, 7 Drawing Sheets

OCTAGONAL EDUCATIONAL STRUCTURE WITH EDUCATIONAL, PROFESSIONAL, PHYSICAL AND MORAL DEVELOPMENTAL ASPECTS

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

Field of the invention: This invention relates to the general field of building structures, and more specifically, to an educational structure with two octagonal structures—one above the ground and one below the ground—with interconnecting corridors and vertical shafts. Each octagonal section and eight separate centers, each with its own educational theme. The corridors also have educational themes, such that a person can walk through the invention and be exposed to a wide range of educational, professional, physical and academic activities.

The use of buildings to house educational institutions dates back thousands of years. The last millennia saw the establishment of museums to provide educational experiences to their visitors—experiences that have become more and more interactive during the last hundred years. The current invention provides an interactive, educational structure with two octagonal structures—one above the ground; the other below the ground—interconnected by a series of corridors and vertical shafts. On each vertices of both the above-ground and the below-ground octagon there is an educational unit with a specific theme. The vertical and horizontal connections between the educational unit each have their own educational theme. The goal of the invention is to allow a person to walk through the various educational areas, stopping for an interactive experience in areas of interest, and walking past areas in which the user has little interest. Some of the "hubs" may deal with specific professions; others may cover a "hand's on" simulator that allows the user to see what it would be like to fly, hang glide, or guide a toboggan down an icy track. Still others may cover an academic discipline such as history, geography or music, which others may give the user an idea of what a certain profession would entail on a day-to-day basis. The term "profession" is used broadly and encompasses both trade schools and professional requiring advanced degrees.

In addition to the benefits of the educational and professional development that users would obtain by visiting the invention, and the usual health benefits from walking up and down stairs, many visitors will benefit from the physical challenge of the gym, graduated-in-exercise obstacle courses and other physical activities that would be located in the lower structure.

The inventor, a graduate of The Stony Brook School known for its motto "Character Before Career", has created this invention partly with the goal of challenging visitors to become better persons through their experience in the structure.

OBJECTS OF THE INVENTION

It is therefore an object of the present invention to provide a structure providing a multi-faceted educational and academic experience offering a user the opportunity to learn about a wide range to topics of interest to people of all ages and backgrounds.

An additional object of the invention includes providing an educational experience that includes optional physical exercise as part of the experience.

Another object of the invention is to locate physical exercise gyms, obstacle courses and the like in the lower structure.

A further object of the invention is to provide a series of separate educational hubs and spokes where a user can walk through the various hubs and spokes and selectively interact or not interact with each section.

An additional object of the invention is to provide users with a chance to explore various professions and to get a glimpse into what their lives might be like if they chose a particular profession.

A further object of the invention is to provide a user-friendly, interactive set of encounters with various machines and artifacts that would simulate experiences that most people do not get to experience as part of their daily lives.

A final object of the invention is to display in an eye-catching and interesting manner a variety of academic disciplines that allow a user to appreciate a wide range of topics in art, history, literature and science.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

BRIEF DESCRIPTION OF THE FIGURES

One preferred form of the invention will now be described with reference to the accompanying drawings.

DETAILED DESCRIPTION OF THE FIGURES

Figure 1:
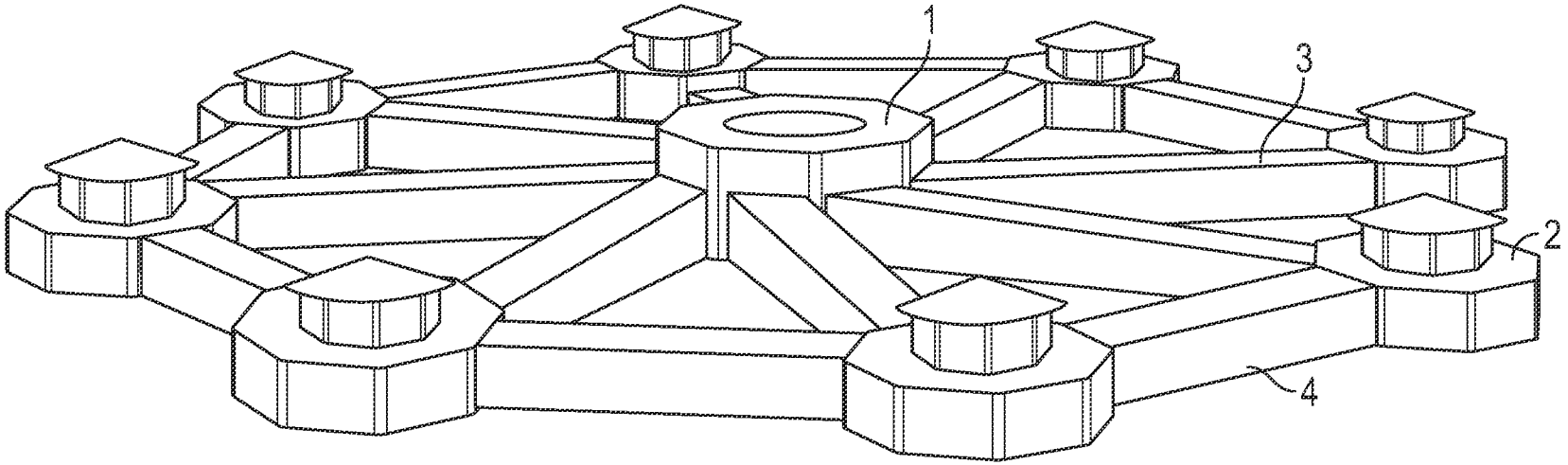
FIG. 1 is a perspective view of the above-ground section of the invention.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

FIG. 1 is a perspective view of the above-ground section of the invention. The invention is centrally located around an upper central hub 1. A series of eight upper units 2 are located in an octagonal design around the upper central hub 1. Each upper unit 2 is connected to the upper central hub 1 by an upper spoke corridor 3. Each upper unit 2 is connected to its two adjoining units by upper connecting corridors 4.

Figure 2:
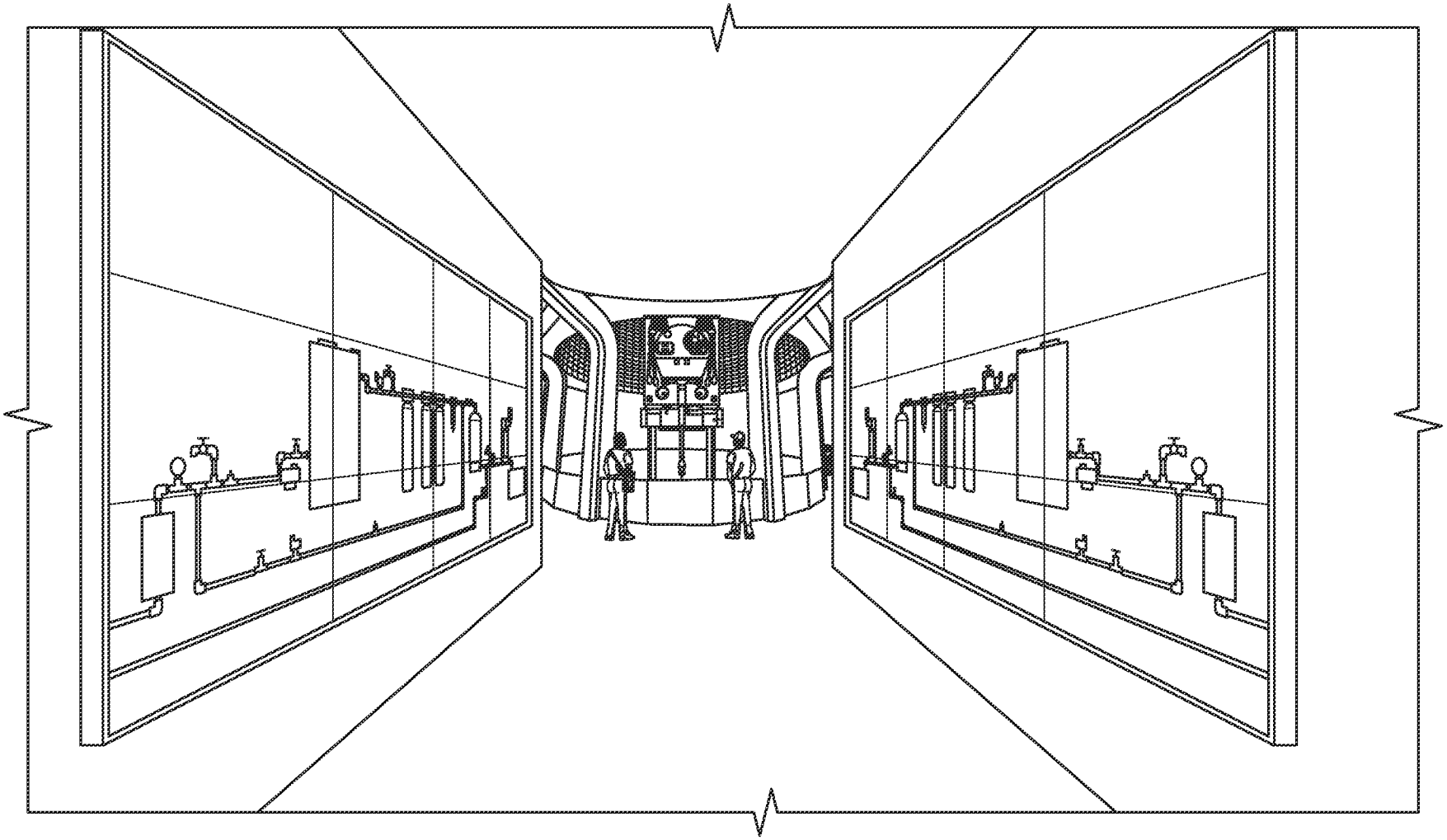
FIG. 2 is a cross-sectional, perspective view of a corridor leading to a hub.

FIG. 2 is a cross-sectional, perspective view of a corridor leading to a hub.

Figure 3:
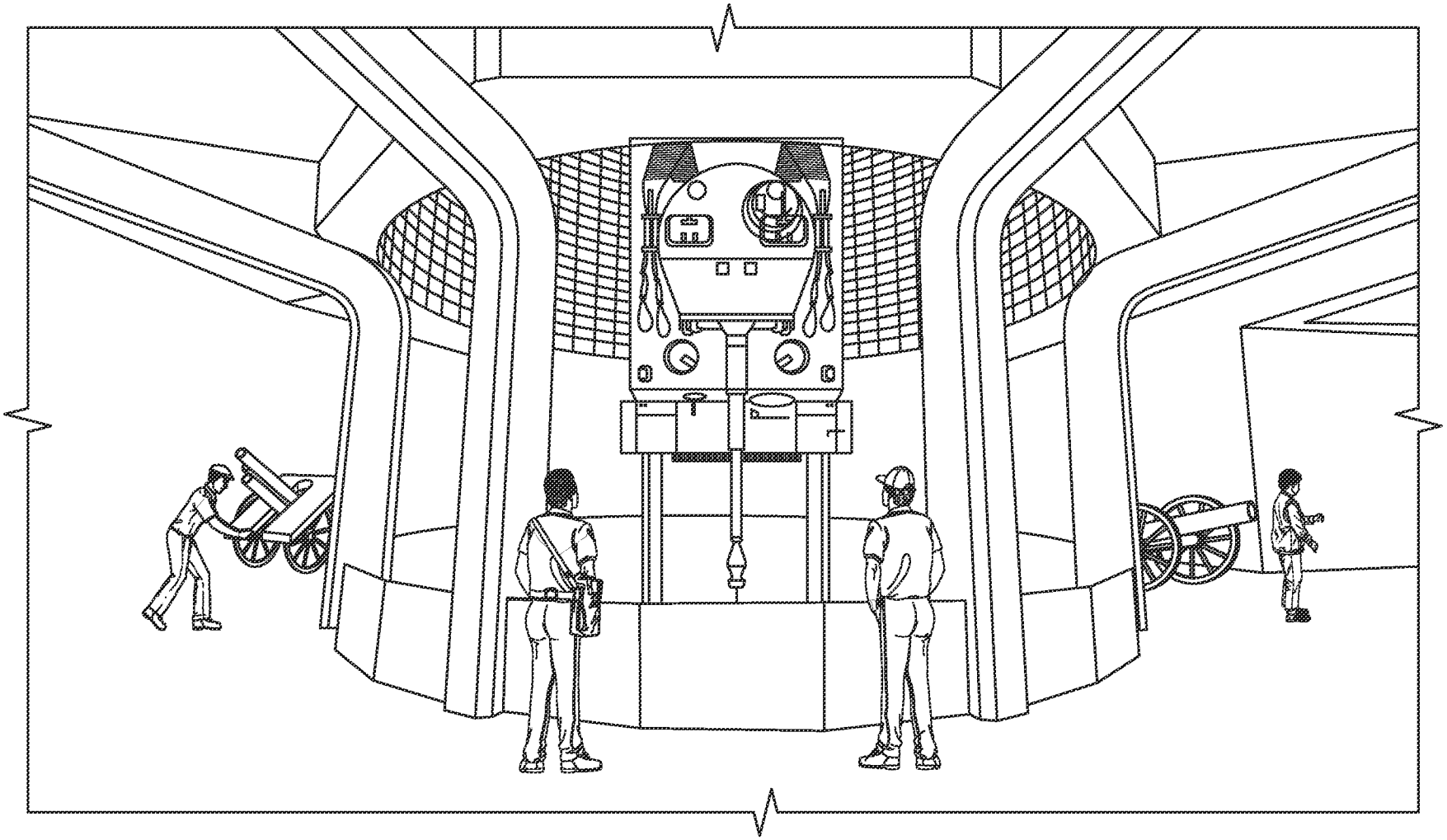
FIG. 3 is a perspective view of a hub.

FIG. 3 is a perspective view of a hub.

Figure 4:
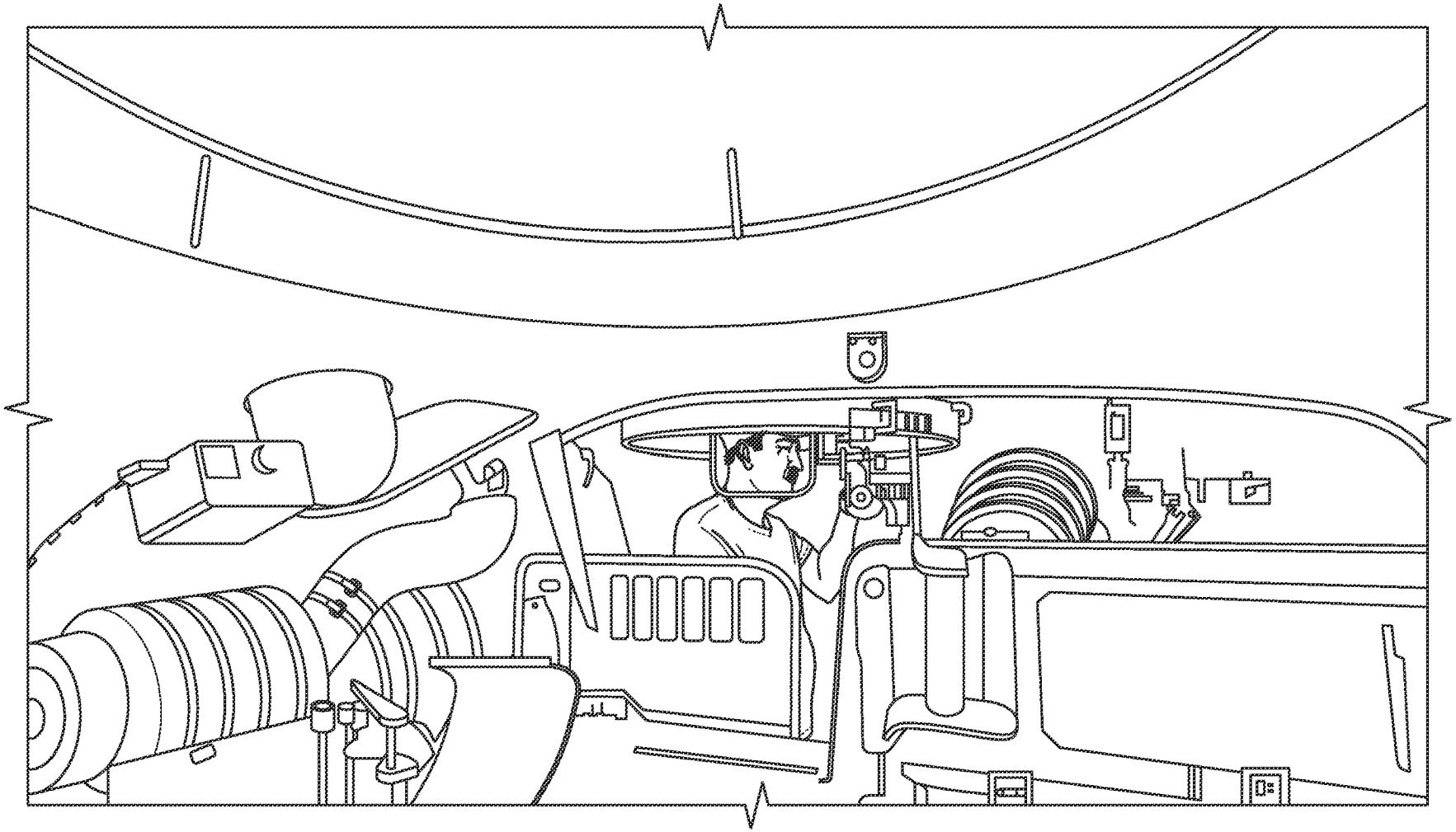
FIG. 4 is perspective view of a flight simulator in one of the hubs.

FIG. 4 is perspective view of a flight simulator in one of the hubs.

Figure 5:
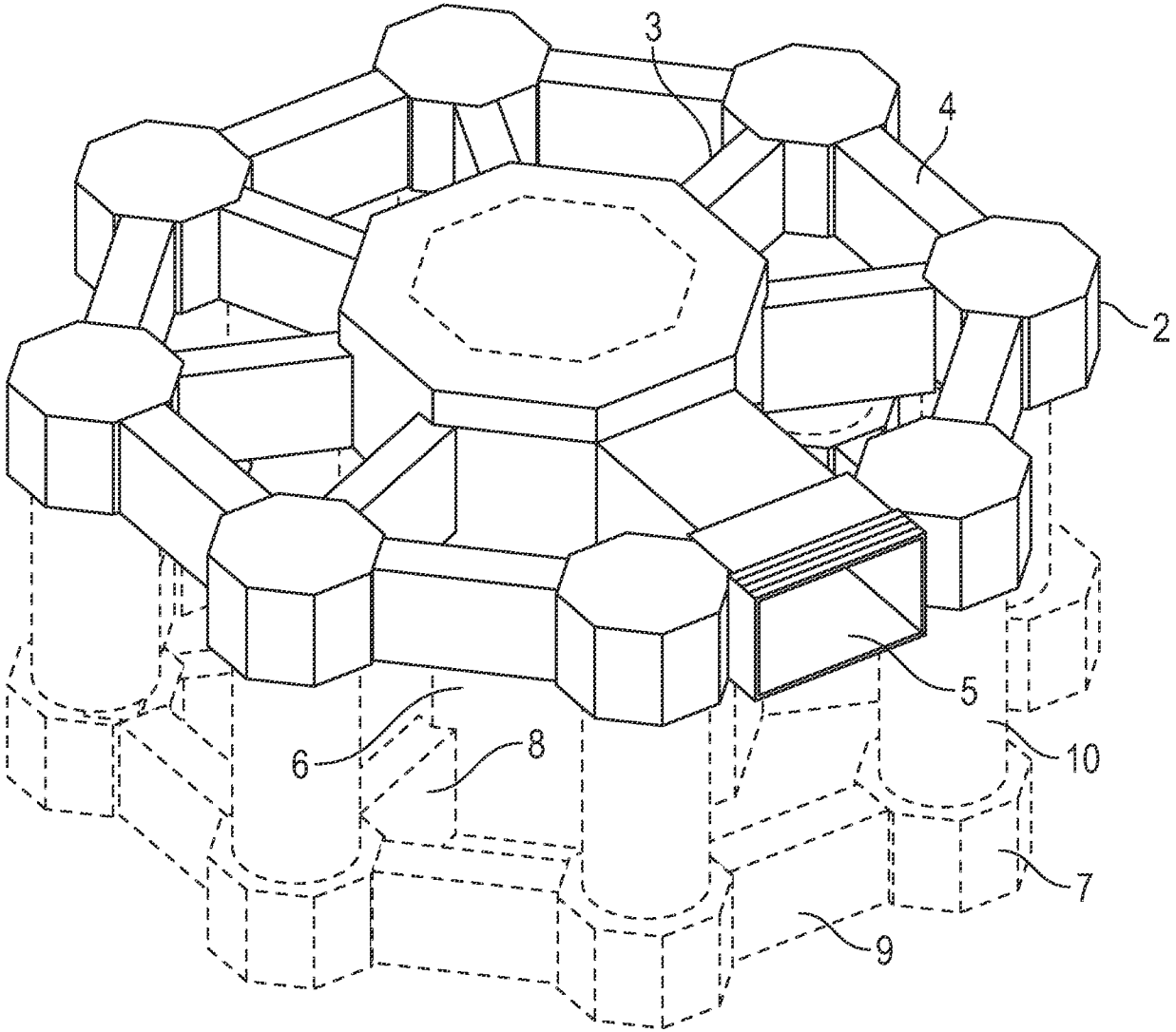
FIG. 5 is a perspective view of both the above-ground and below-ground sections of the invention.

FIG. 5 is a perspective view of both the above-ground and below-ground sections of the invention. Above the ground, eight upper units 2 are connected to the upper central hub 1 by upper spoke corridors 3, and to each adjacent upper unit by upper connecting corridors 4. An entry 5 provide entry and exit to the structure. Below the ground, a lower central hub 6 is connected to an octagonal shape with lower units 7 at the vertices of the octagon, and each lower unit 7 is connected to the two adjacent lower unit by lower connecting corridors 9. The upper central hub is connected to the lower central hub, and each upper unit is connected to the lower until beneath it by vertical shafts 10.

Figure 6:
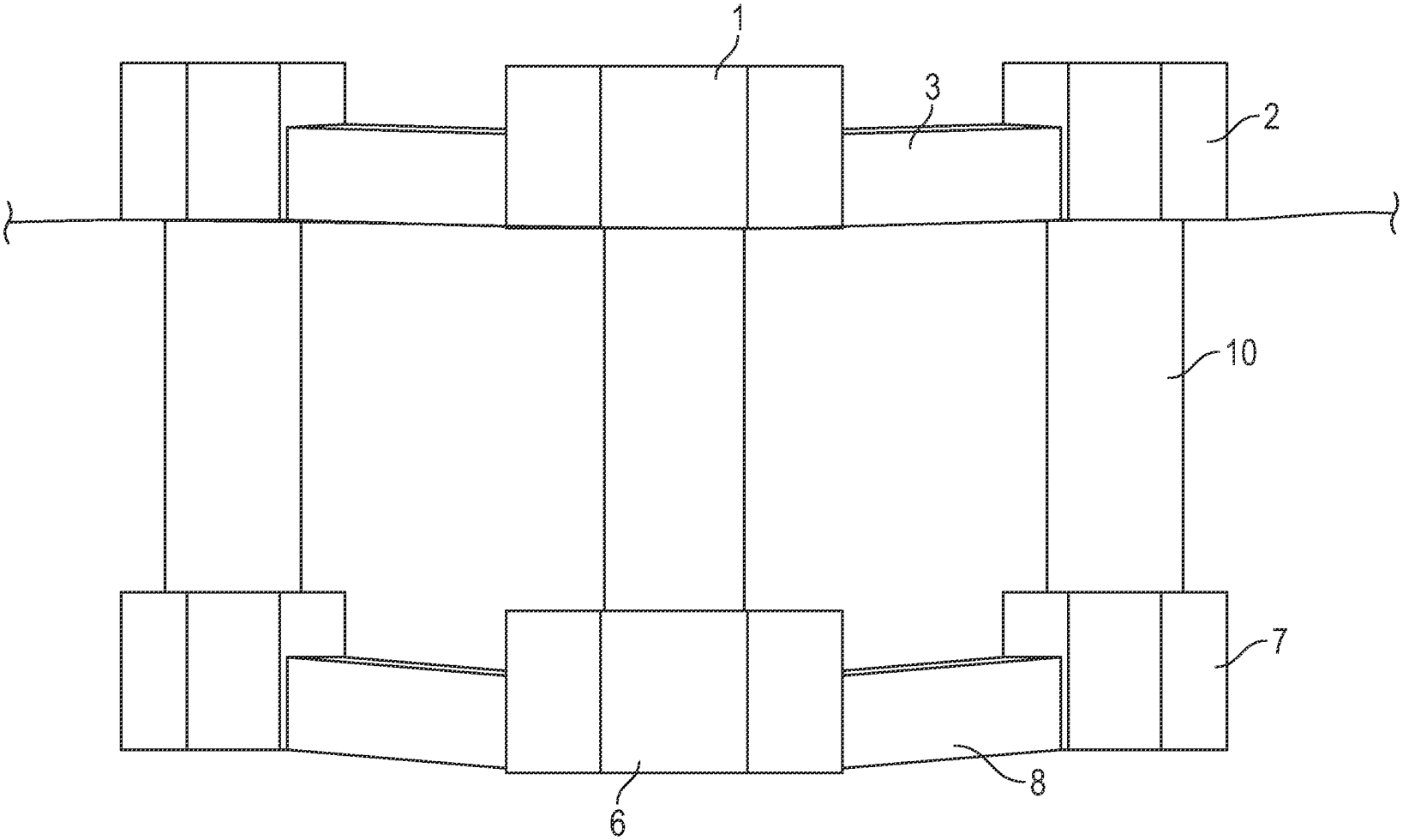
FIG. 6 is a cross-sectional view of the invention showing the upper and lower aspects of the invention and the interconnections between the various parts of the invention.

FIG. 6 is a cross-sectional view of the invention showing the upper and lower aspects of the invention and the interconnections between the various parts of the invention, showing how vertical shafts 10 connect the above-ground section of the invention with the below-ground section.

Figure 7:
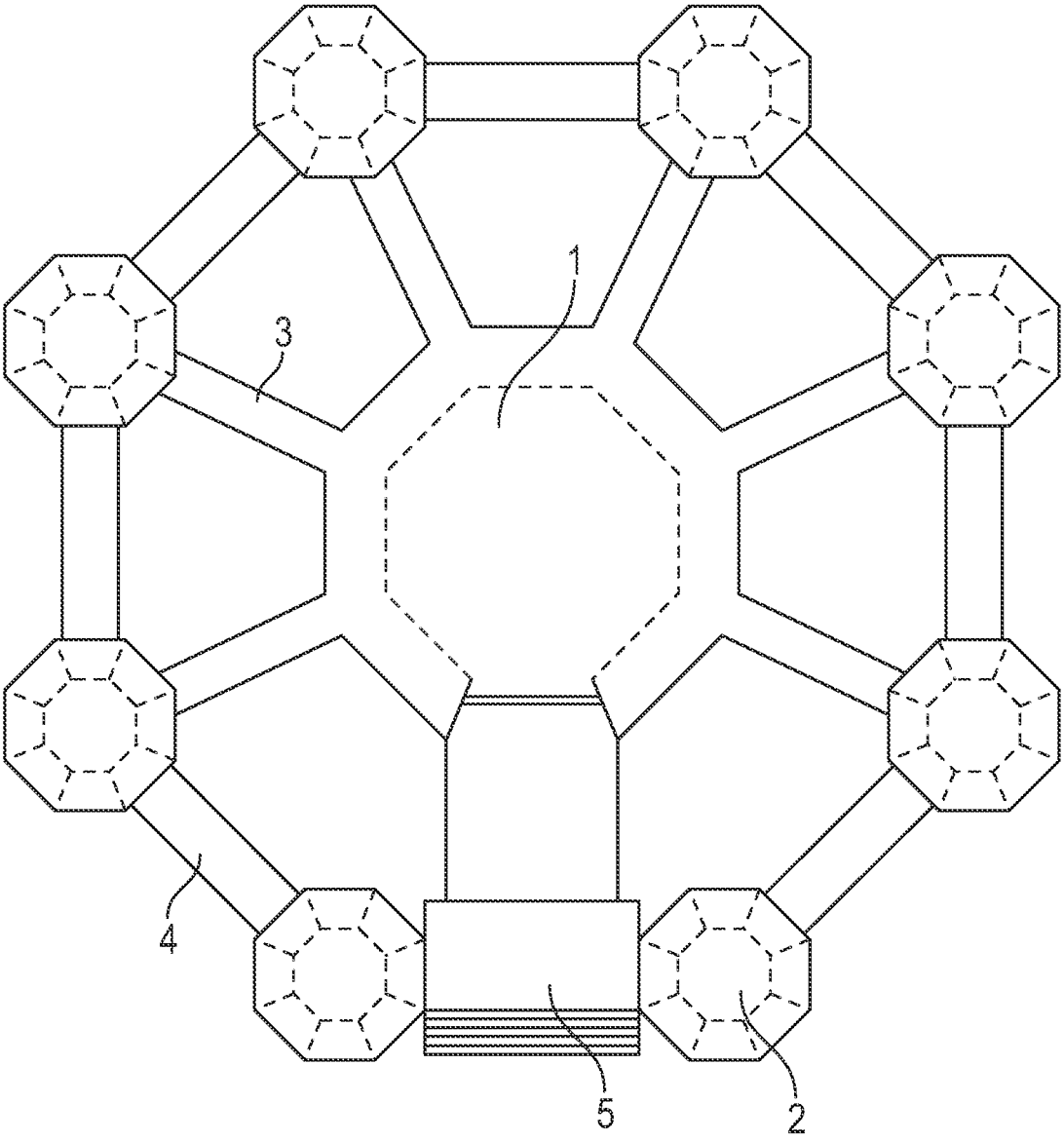
FIG. 7 is a top view of the invention.

FIG. 7 is a top view of the invention, showing the interrelationship between the upper central hub 1, the upper spokes corridors 3, the upper units 2, the upper connecting corridors 4 and the entry 5.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

An experience in the invention begins at the entry 5. The entry is a grand entryway that gives visitors an instant impression of not only all the various facets that they will find inside, but also cements in their mind the belief that the entry fee will be worth the experience. Visitors walk through an upper spoke corridor 3 to the upper central hub 1. From the central hub 1, eight upper spoke corridors 3 radiate out to eight upper units 2. Each upper unit 2 is connected to the adjacent upper units by upper connecting corridors 4.

Below the ground is a similar octagonal structure with a lower central hub 6 from which eight lower spoke corridors 8 radiate out to eight lower units 7. These eight lower units 7 are connected to adjacent lower units by lower connecting corridors 9. Vertical shafts 10 connect the lower central hub to the upper central hub, and each lower unit to the upper unit above each over unit.

While the central design is fully described in this patent application, the invention is scalable depending on the financial abilities and expected visitation for particular locations. Because of the wide variety of professional and academic experiences offered, no matter the size of the eventual structure, it will be appreciated by everyone from teenagers wondering what they should choose for a major to an adult going through a mid-life crisis wondering what his/her new career should be.

The upper central hub 1 is main organizational center of the above-ground part of the invention, with a restaurant, amphitheater, shop and the control center for the structure. Each upper unit 2 is divided into six rooms or divisions with a different theme. All of the upper units 2 are reserved for academic disciplines ranging from mathematics to astrophysics, from medieval literature to modern art, and including sections on a variety of professions. The professions exhibited would be very wide in range, varying from professions required an advanced degree such as doctors, lawyer and architects to trades such as pipefitters, arborists and cattle ranchers. The general goal of the above-ground section of the invention is to provide choices and encourage a visitor to develop an inclination toward either a major in college or a new job for visitors contemplating a career change. By mixing academia and previews of various professions, visitors will be entertained and find at least one or two themes of each unit that they find interesting.

The below-ground section of the invention has a lower central hub 6, that serves as the center of this part of the invention. The lower central hub can house a recovery room, first aid center, and features related to physical fitness such as rock-climbing walls, flight simulators, tank simulators, a skydiving tunnel and other "hands on" experiences. Combining intellectual stimulation with physical exercise provides benefits to both to personal development and the mental health of visitors.

The various corridors provide physical exercise as visitors move from one part of the invention to another. However, in walking through a corridor, a visitor has the opportunity to learn from general subjects. For example, one side of a corridor could feature the history of trains, while the other side could have a detailed explanation of how a locomotive was built.

The vertical shafts 10 can be elevators and/or stairs, to both provide access for physically-challenge visitors as well as exercise for other visitors. The vertical nature of these shafts also lends themselves to skydiving simulators and other vertical experiences. The vertical shafts can also be used for educational themes, such as the history of the manufacturing of shoelaces.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

That which is claimed:

1. A structure providing space for providing an educational, professional, physical and inspirational experience consisting of:

an above-ground section, where the above-ground section comprises an entrance, an upper central hub, eight upper units, eight upper connecting corridors and six upper spoke corridors, where the eight upper units are arrayed around the upper central hub in an octagonal shape, where each of the eight upper units is connected to two adjacent upper units by the upper connecting corridors, and six of the eight upper units are connected to the upper central hub by a spoke corridor, a below-ground section, where eight lower units are arrayed around a lower central hub in an octagonal shape, where each of the eight lower units is connected to two adjacent lower units by lower connecting corridors, and the eight lower units are connected to the lower central hub by a lower spoke corridor, a plurality of vertical shafts, where the upper central hub is connected to the lower central hub by one of the plurality of vertical shafts, and each of the eight upper units is connected to a lower unit by one of the plurality of vertical shafts, where, the upper central hub comprises a restaurant, and amphitheater, a shop, and control/security center, where, each of the eight upper units is divided into six subsections, where each of the six subsections features a different academic theme, where, each of the upper connecting corridors and each of the upper spoke corridors features two general educational subjects, where, the lower central hub comprises a first air station, a recovery room, and at least one physical fitness device, where, each of the eight lower units is divided into six subsections, where each of the six subsections features a different academic theme, where, each of the lower connecting corridors and each of the lower spoke corridors features two general educational subjects, where, each of the plurality of vertical shafts provides a physical fitness experience.

2. The structure of claim 1, where the eight upper units, the eight lower units, the eight upper connecting corridors and the six upper spoke corridors all comprise at least one theme selected from the group consisting of: educational experiences, professional experiences and academic experiences.

3. The structure of claim 1, where the physical fitness experience includes a skydiving simulator.

4. A structure providing space for providing an educational, professional, physical and inspirational experience comprising:

an above-ground section, where the above-ground section comprises an entrance, an upper central hub, eight upper units, eight upper connecting corridors and six upper spoke corridors, where the eight upper units are arrayed around the upper central hub in an octagonal shape, where each of the eight upper units is connected to two adjacent upper units by the upper connecting corridors, and six of the eight upper units are connected to the upper central hub by a spoke corridor, a below-ground section, where eight lower units are arrayed around a lower central hub in an octagonal shape, where each of the eight lower units is connected to two adjacent lower units by lower connecting corridors, and the eight lower units are connected to the lower central hub by a lower spoke corridor, a plurality of vertical shafts, where the upper central hub is connected to the lower central hub by one of the plurality of vertical shafts, and each of the eight upper units is connected to a lower unit by one of the plurality of vertical shafts, where, the upper central hub comprises a restaurant, and amphitheater, a shop, and control/security center, where, each of the eight upper units is divided into six subsections, where each of the six subsections features a different academic theme, where, each of the upper connecting corridors and each of the upper spoke corridors features two general educational subjects, where, the lower central hub comprises a first air station, a recovery room, and at least one physical fitness device, where, each of the eight lower units is divided into six subsections, where each of the six subsections features a different academic theme, where, each of the lower connecting corridors and each of the lower spoke corridors features two general educational subjects, where, each of the plurality of vertical shafts provides a physical fitness experience.

5. A structure providing space for providing an educational, professional, physical and inspirational experience comprising: an upper unit, a lower unit, a plurality of vertical shafts, where the upper unit comprises an entrance, an upper central hub, eight upper units, eight upper connecting corridors and six upper spoke corridors, where the plurality of vertical shafts connects the upper unit to the lower unit, where the lower unit comprises a lower central hub, eight lower units, lower connecting corridors and eight lower spoke corridors, where the eight lower units are arrayed around the lower central hub in an octagonal shape, where each of the eight lower units is connected to the two adjacent lower units by the lower connecting corridors, and the eight lower units are connected to the lower central hub by a lower spoke corridor, where the upper unit, the lower unit, the eight upper connecting corridors and the six upper spoke corridors all comprise at least one theme selected from the group consisting of: educational experiences, professional experiences and academic experiences.

6. The structure of claim 5, where the eight upper units are arrayed around the upper central hub in an octagonal shape, where each of the eight upper units is connected to the two adjacent upper units by the upper connecting corridors, and six of the eight upper units are connected to the upper central hub by a spoke corridor, where the upper central hub is connected to the lower central hub by one of the plurality of vertical shafts, where each of the eight upper units is connected to a lower unit of the eight lower unit by one of the plurality of vertical shafts, where the upper central hub comprises at least one of a restaurant, and amphitheater, a shop, and control/security center, where each of the upper units is divided into six subsections, where each of the six subsections, where each of the six subsections features a different academic theme, where each of the upper connecting corridors and each of the upper spoke corridors features two general subjects, where the lower central hub comprises a first air station, a recovery room, and at least one physical fitness device, where each of the lower units is divided into six subsections, where each of the six subsections, where each of the six subsections features a different academic theme, where each of the lower connecting corridors and each of the lower spoke corridors features two general subjects, where each of the plurality of vertical shafts provides a physical fitness experience, such as a skydiving simulator.

* * * * *